US011597542B2

(12) United States Patent
Kupyna et al.

(10) Patent No.: US 11,597,542 B2
(45) Date of Patent: Mar. 7, 2023

(54) FILLING DEVICE

(71) Applicants: Elopak AS, Spikkestad (NO); Elopak GmbH, Speyer (DE)

(72) Inventors: Andriy Kupyna, Oslo (NO); Andreas Lennartz, Schwalmtal (DE); Peter Barth, Aachen (DE); Dirk Auer, Meerbusch (DE); Franz-Willi Spelten, Wegberg (DE)

(73) Assignee: Elopak ASA, Spikkestad (NO)

( * ) Notice: Subject to any disclaimer, the term of this patent is extended or adjusted under 35 U.S.C. 154(b) by 0 days.

(21) Appl. No.: 16/771,695

(22) PCT Filed: Dec. 13, 2018

(86) PCT No.: PCT/EP2018/084798

§ 371 (c)(1),
(2) Date: Jun. 11, 2020

(87) PCT Pub. No.: WO2019/115708

PCT Pub. Date: Jun. 20, 2019

(65) Prior Publication Data

US 2021/0086924 A1 Mar. 25, 2021

(30) Foreign Application Priority Data

Dec. 15, 2017 (GB) ..... 1721031

(51) Int. Cl.
*B65B 3/04* (2006.01)
*B65B 39/00* (2006.01)
(Continued)

(52) U.S. Cl.
CPC ..... *B65B 3/04* (2013.01); *B65B 39/004* (2013.01); *B65B 2039/009* (2013.01); *B67C 3/2608* (2013.01); *B67C 3/28* (2013.01)

(58) Field of Classification Search
CPC ... B65B 39/004; B65B 2039/009; B67C 3/28; B67C 3/2608
See application file for complete search history.

(56) References Cited

U.S. PATENT DOCUMENTS 4,512,379 A * 4/1985 Hennig ..... B65B 3/22 141/286
9,909,289 B2 * 3/2018 Kilian ..... E03C 1/08
(Continued)

FOREIGN PATENT DOCUMENTS

CN 105517907 A 4/2016
CN 105668490 A 6/2016
(Continued)

OTHER PUBLICATIONS

Office Action and Search report dated Aug. 16, 2021 in CN application 2018800803711 (with summarized translation).
(Continued)

*Primary Examiner* — Timothy L Maust
(74) *Attorney, Agent, or Firm* — Christian D. Abel

(57) ABSTRACT

A filling device (10) comprises a filler nozzle (12) comprising a plurality of capillaries (14), and a filler valve (16), which is moveable relative to the filler nozzle (12). The filler valve (16) comprises a sealing plate (18) and a sealing component (20) moveable relative to the sealing plate (18). The sealing plate (18), when in contact with the filler nozzle (12), closes a plurality of the capillaries (14) but leaves at least one main capillary (14*a*) open. The sealing component (20) closes the at least one main capillary (14*a*) and is operable to create pressure along the at least one main capillary (14*a*).

20 Claims, 16 Drawing Sheets

(51) Int. Cl.
*B67C 3/26* (2006.01)
*B67C 3/28* (2006.01)

(56) References Cited

U.S. PATENT DOCUMENTS

| | | | | |
|---|---|---|---|---|
| 9,909,290 | B2 * | 3/2018 | Hortmanns | B67C 3/281 |
| 9,926,088 | B2 * | 3/2018 | Auer | B65B 39/004 |
| 10,302,214 | B2 | 5/2019 | Bandini et al. | |
| 10,472,218 | B2 * | 11/2019 | Auer | B65B 3/22 |
| 10,562,655 | B2 * | 2/2020 | Heuser | B67C 3/2608 |
| 2016/0022170 | A1 | 1/2016 | Candidus et al. | |

FOREIGN PATENT DOCUMENTS

| | | | |
|---|---|---|---|
| CN | 106335864 | A | 1/2017 |
| CN | 106672880 | A | 5/2017 |
| DE | 102010006005 | | 7/2011 |
| DE | 102010006005 | A1 | 7/2011 |
| EP | 0240694 | | 10/1987 |
| EP | 240694 | | 10/1987 |
| EP | 0240694 | A2 | 10/1987 |
| EP | 1129949 | | 9/2001 |
| GB | 1127713 | A | 9/1968 |
| GB | 2247672 | A | 3/1992 |
| GB | 1657159 | A1 | 5/2006 |
| WO | 2006/091159 | | 8/2006 |
| WO | 2015/074803 | | 5/2015 |

OTHER PUBLICATIONS

Search report and official action, Russia Patent Office, dated Mar. 18, 2022.

* cited by examiner

FILLING DEVICE

This invention relates to a filling device and to a method of operating the filling device.

In liquid food packaging, containers are filled using a filling device. Filling devices normally include a filling nozzle from which the liquid food is dispensed into the container and a filling valve, which controls the flow of the liquid food through the filling nozzle, normally dosing the liquid food according to the size of the container being filled. Common containers that are used for packaging liquid food products include cartons that are made from plastics-coated paperboard. Liquid food products include milk and fruit juice and also more viscous products such as soup and bases for sauces and so on. Different filling devices are used depending upon the type of liquid food product being filled and the rate at which containers are to be filled. A known problem with filling devices that are being used to fill more viscous products is that some amount of product can tend to remain hanging from the filler nozzle and drip down uncontrolled on to the package's outer and inner surfaces, which can lead to problems of food hygiene and container sealing.

United States of America patent application publication US 2016/0221700 discloses a device for controlling flow rate. The device for controlling the flow rate of flowable products, in particular of foodstuffs, comprises a valve rod, a sealing element with at least one sealing lip connected to the valve rod, wherein the sealing element comprises a base plane and a contact plane, wherein the sealing lip is arranged on the contact plane and an outlet element with a stop plane and with at least one outlet channel, wherein the stop plane has at least one sealing region assigned to the sealing lip and at least one outlet region connected to the outlet channel. The contact plane is spaced apart from the base plane, so that an offset is created between the sealing lip and the base plane.

It is therefore an object of the invention to improve upon the known art.

According to a first aspect of the present invention, there is provided a filling device comprising a filler nozzle comprising a plurality of capillaries, and a filler valve moveable relative to the filler nozzle, characterised in that the filler valve comprises a sealing plate which, when in contact with the filler nozzle, closes a plurality of the capillaries but leaves at least one main capillary open, and a sealing component moveable relative to the sealing plate, which is operable to close the at least one main capillary and to create pressure along the at least one main capillary.

According to a second aspect of the present invention, there is provided a method of operating a filling device comprising opening a sealing plate of a filler valve to provide a flowable product from a filler nozzle comprising a plurality of capillaries, to a partially formed container, the method characterised by closing the sealing plate which, when in contact with the filler nozzle, closes a plurality of the capillaries but leaves at least one main capillary open, closing a sealing component of the filler valve, which closes the at least one main capillary, operating the sealing component to create pressure along the at least one main capillary, and reversing the operation of the sealing component to create suction along the at least one main capillary.

Owing to the invention, it is possible to provide an improved filling device that can be used to fill a partially formed container with a viscous flowable product that will not have the risk of the product dripping uncontrolled from the filler nozzle after dosing from the filling device. The main capillary (or capillaries) of the filler nozzle can have additional pressure provided along its length, which causes more of the product to be expelled through this capillary (or capillaries) compared to other capillaries, which can then be reversed to provide suction along the main capillary (or capillaries), which draws any excess product on the end of the filler nozzle back inside the filler nozzle, thereby preventing any product from dripping uncontrolled from the filling device.

By having not all of the capillaries closed by the sealing component, two significant advantages are delivered. Firstly, the sealing plate, which closes the capillaries not closed by the sealing component, is less likely to suffer the wear and tear that would result if the component is continually sealing all of the capillaries, given the pressure exerted to create a seal of all of the capillaries. Secondly, since there are two different components closing the capillaries, it is possible to run the filling device with only the main capillary open, which has a tendency to draw any excess product on the end of the other capillaries towards that main capillary, making it easier to suck back the product into the filler nozzle, when suction is provided through the main capillary.

Preferably, the main capillary is located centrally within the filler nozzle and the sealing plate, when in contact with the filler nozzle closes a plurality of the capillaries but leaves only one main capillary open. In the preferred embodiment of the filling device there is provide a single main capillary (the one that is left open by the sealing plate) which is located centrally within the filler nozzle. This arrangement provides the simplest way of achieving the overall desired aim of removing the likelihood that a viscous flowable product will have an uncontrolled drip from the filler nozzle, since a single central main capillary is provided that can provide the necessary suck back to draw back any excess product that is left on the end of the filler nozzle.

Advantageously, each capillary closed by the sealing plate, at the end of the filler nozzle adjacent to the sealing plate, includes a tube extending from the filler nozzle, with the main capillary (or capillaries), at the end of the filler nozzle adjacent to the sealing plate, terminating at the filler nozzle and the sealing plate comprising, on its side adjacent to the filler nozzle, a plurality of caps arrange to close each capillary closed by the sealing plate and one or more elongate tubes arranged to engage with the main capillary (or capillaries). In this way, the sealing plate can provide a good seal onto those capillaries that are to be closed by the sealing plate while leaving the main capillary open, with an elongate tube in the sealing plate providing a connection from the main capillary to the other side of the sealing plate, where the main capillary can be closed by the sealing component.

Ideally, the sealing component of the filler valve comprises a flexible sealing component, for example formed as a silicone rubber cap. The sealing component can be constructed from any suitable material that has the necessary functional properties and is safe for use in a liquid food environment. Any flexible plastics material can be used that is sufficiently robust to be compressible. The flexible sealing component is moveable independently of the sealing plate of the filler valve and serves the purpose of closing the main capillary, which is not closed by the sealing plate. The flexible sealing component can be compressed to create pressure along the main capillary and releasing the compression causes suction to be generated along the main capillary.

Embodiments of the present invention will now be described, by way of example only, with reference to the accompanying drawings, in which.

Figure 1:
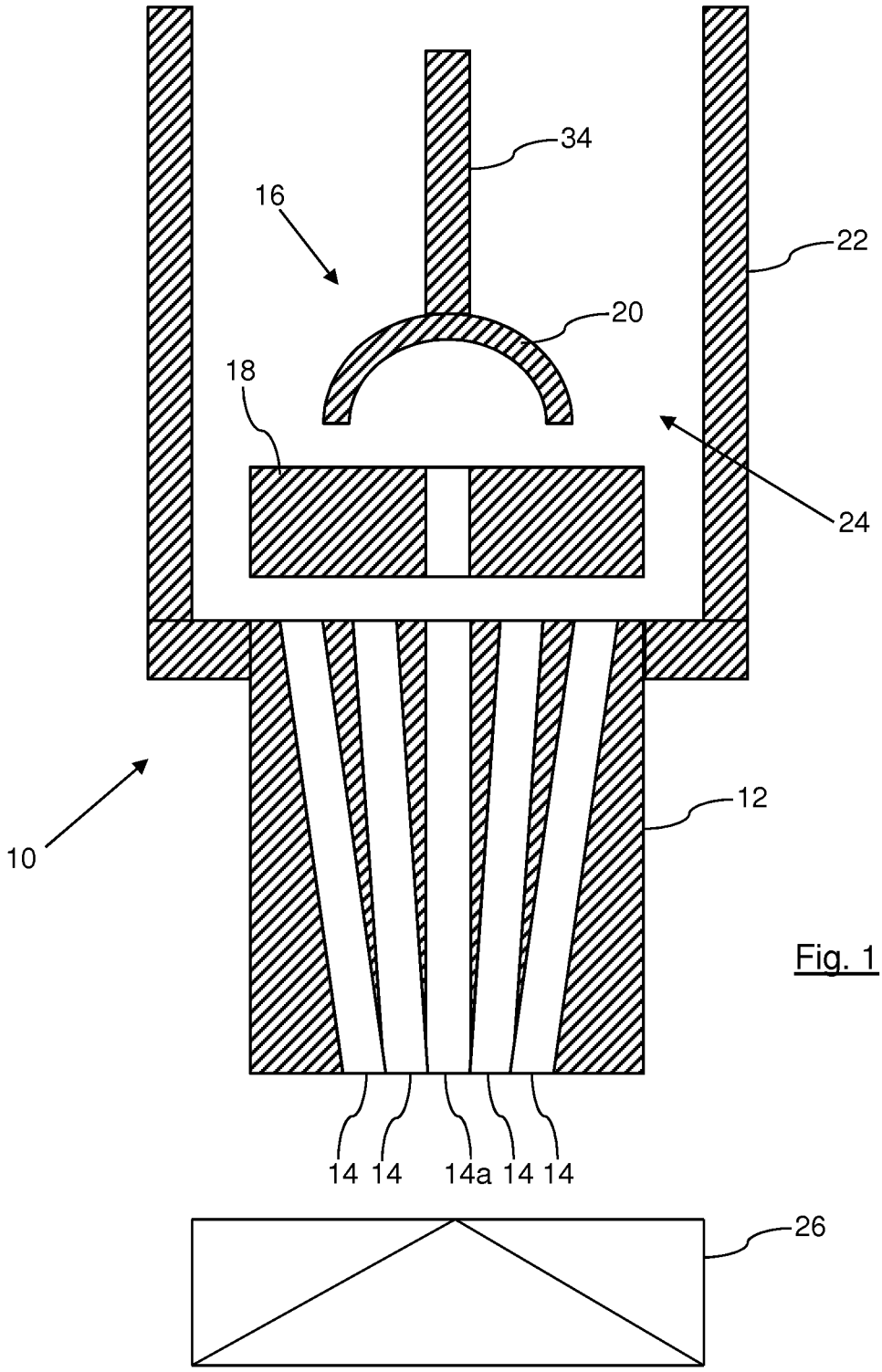
FIG. 1 is a vertical cross-section of a filling device.

FIG. 1 shows a vertical cross-section through a filling device 10. The filling device 10 comprises a filler nozzle 12 comprising a plurality of capillaries 14, and a filler valve 16 moveable relative to the filler nozzle 12. The filler valve 16 is in two parts and comprises a sealing plate 18 which, when in contact with the filler nozzle 12, closes a plurality of the capillaries 14 but leaves at least one main capillary 14*a* open, and a sealing component 20 (connected to a shaft 34) moveable relative to the sealing plate 18, which, when in contact with the sealing plate 18, closes the at least one main capillary 14*a*, and is operable to create pressure along the main capillary 14*a*.

The valve 16 operates inside a housing 22, which contains flowable product 24, which is gravity fed through the filling device 10 into a partially formed container 26 (the top of which is shown in the Figure). The flowable product 24 is a liquid food product with a relatively high viscosity, such as a soup which contains some solid food matter. The operation of the valve 16 doses the product 24 into the partially formed container 26, which, once full, is moved on to a different station to be top-sealed. The operation of the valve 16 will be described in more detail below, as the function of the valve 16 is to ensure that the product 24 is not left dripping from the filler nozzle 12, in addition to its dosing function.

The plurality of capillaries 14 are arranged longitudinally within the filler nozzle 12. The main capillary 14*a* is located centrally within the filler nozzle 12. The capillaries 14 are angled so that at the exit end of the filler nozzle 12 (which is the end opposite to that closed by the sealing plate 18), the capillaries 14 create a single beam of product when the product exits the filler nozzle 12. The sealing plate 18, when in contact with the filler nozzle 12 closes a plurality of the capillaries 14 but leaves only one main capillary 14*a* open. In this preferred embodiment of the filling device 10, there is a single main capillary 14*a*, centrally located in the filler nozzle 12, which has a more complex function that the other capillaries 14 that are surrounding the main capillary 14*a*. However, the nozzle 12 can be constructed with multiple main capillaries 14*a* that operate in the manner described below.

Figure 2:
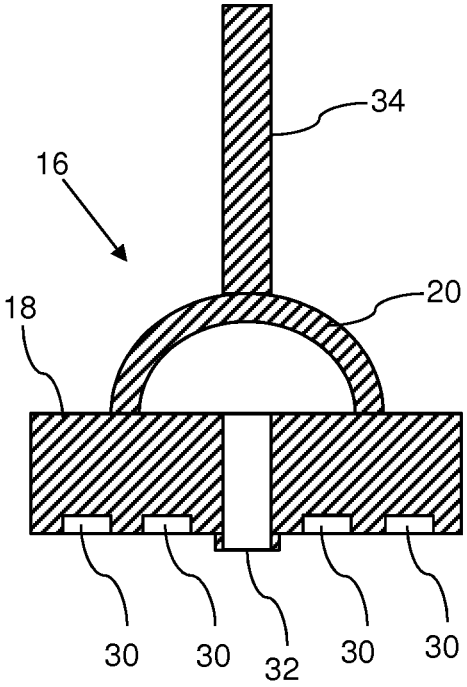
FIG. 2 is a vertical cross-section of a filler valve of the filling device.

FIG. 2 shows a more detailed cross-section of the filler valve 16, which is moveable relative to the filler nozzle 12. The valve 16 comprises the solid sealing plate 18 which, when in contact with the filler nozzle 12, closes a plurality of the capillaries 14 but leaves the main capillary 14*a* open, and a sealing component 20 which is moveable relative to the sealing plate 18, and, when in contact with the sealing plate 18, closes the main capillary 14*a*, and is operable to create pressure along the main capillary 14*a*. The sealing component 20 is a flexible silicone rubber cap, which can be compressed by movement of the shaft 34 which is connected to the flexible sealing component 20.

The sealing plate 18 comprises, on its side that is adjacent to the filler nozzle 12, a plurality of caps 30 arrange to close each capillary 14 closed by the sealing plate 18 and an elongate tube 32 arranged to close the main capillary 14*a*. The elongate tube 32 is arranged to engage with the main capillary 14*a* and passes through the sealing plate 18 and terminates adjacent to the flexible sealing component 20. When the flexible sealing component 20 is open, then the product 24 can flow through the elongate tube 32 of the sealing plate 18 and into the main capillary 14*a* of the filler nozzle 12.

The shaft 34 provides the means for compressing the flexible sealing component 20, since as the shaft 34 is moved up and down, the sealing component 20 also moves up and down. Once the sealing component 20 is in contact with the sealing plate 18, as shown in FIG. 2, then any additional downwards pressure from the shaft 34 will cause the flexible sealing component 20 to be compressed, which creates pressure in the elongate tube 32 and therefore also in the main capillary 14*a*, which forces out product 24 that is present in the lower part of the main capillary 14*a*. When the shaft 34 is raised, decompressing the sealing component 20, then suck back is created in the main capillary 14*a* drawing any excess product 24 remaining on the exterior of the filler nozzle 12 back into the main capillary 14*a*.

Figure 3:
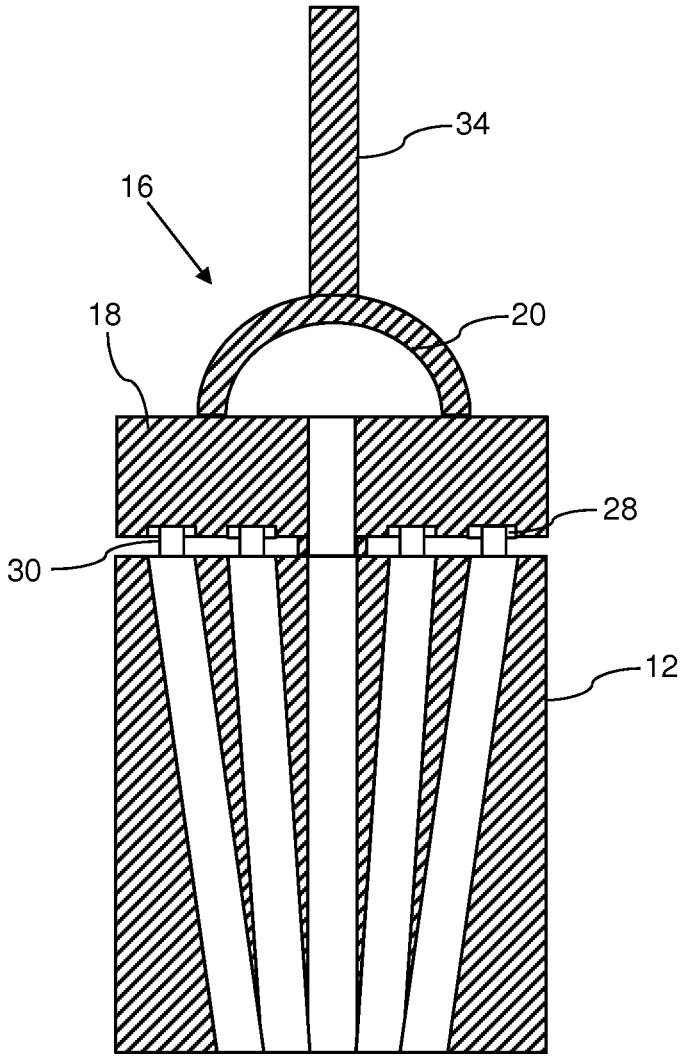
FIGS. 3 to 8 are a series of vertical cross-sections of the filling device in use.

FIG. 3 shows the starting closed position of the filler valve 16 relative to the filler nozzle 12 (with the housing 22 removed for clarity purposes). In this position no product 24 can exit from the filler nozzle 12, since the sealing plate 18 is closing all of the capillaries 14 apart from the central main capillary 14*a* and that capillary 14*a* is closed by the flexible sealing component 20, which is in contact with the sealing plate 18. The shaft 34 controls the movement of the flexible sealing component 20 and additional components (not shown for ease of understanding) control the movement of the sealing plate 18, which moves independently of the flexible sealing component 20 of the filler valve 16.

Additional features of the filler nozzle 12 are shown in this Figure. Each capillary 14 that is closed by the sealing plate 18, at the end of the filler nozzle 12 adjacent to the sealing plate 18, includes a tube 28 extending from the filler nozzle 12. The main capillary 14*a* however, at the end of the filler nozzle 12 adjacent to the sealing plate 18, terminates at the filler nozzle 12. The tubes 28 match the caps 30 of the sealing plate 18, with the sealing plate 18 closing the capillaries 14 by the action of the caps 30 covering the ends of the tubes 28, as can be seen in the Figure.

Figure 4:
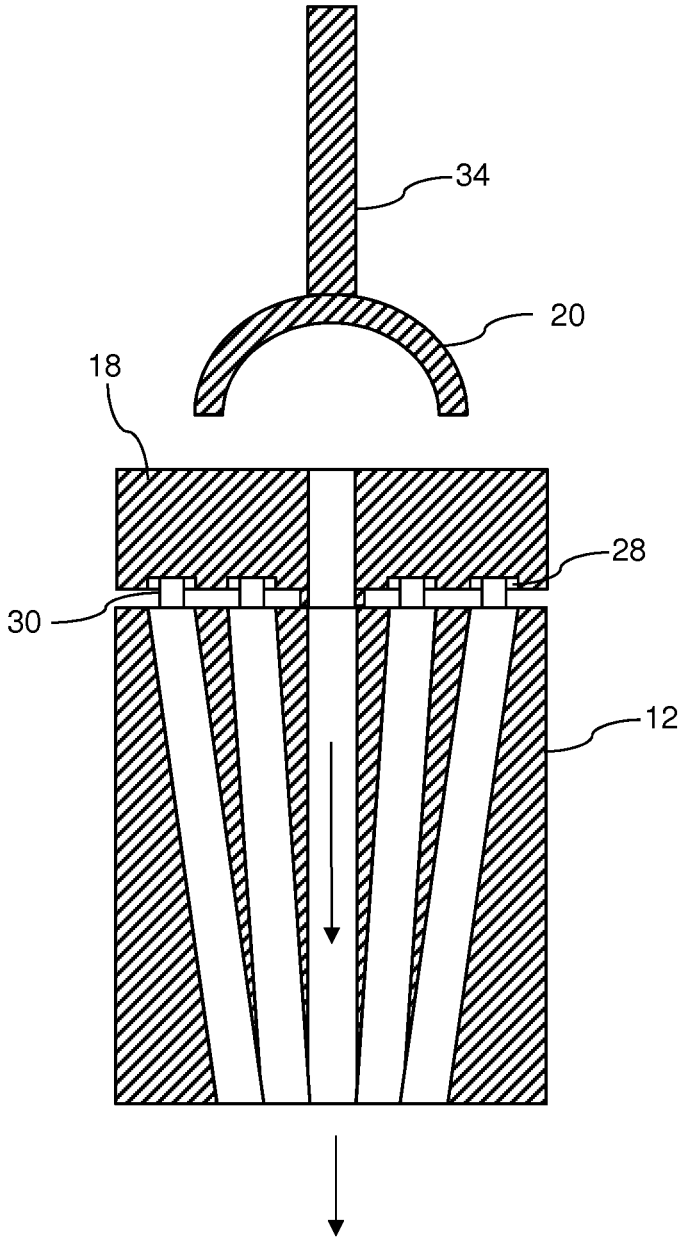

FIG. 4 shows the filling device 10 in its first position of operation with the flexible sealing component 20 moved relative to the sealing plate 18 to open the main capillary 14*a*. The caps 30 of the sealing plate 18 remain in contact with the filler nozzle tubes 28 and still close the remaining capillaries 14. Product 24 can flow through the main capillary 14*a*, as indicated by the arrows in the Figure. All of the other capillaries 14 remain closed and there is no flow of product 24 through these capillaries 14. This is the start of the dosing procedure for outputting product 24 from the filling device 10 into the partially formed container 26.

Figure 5:
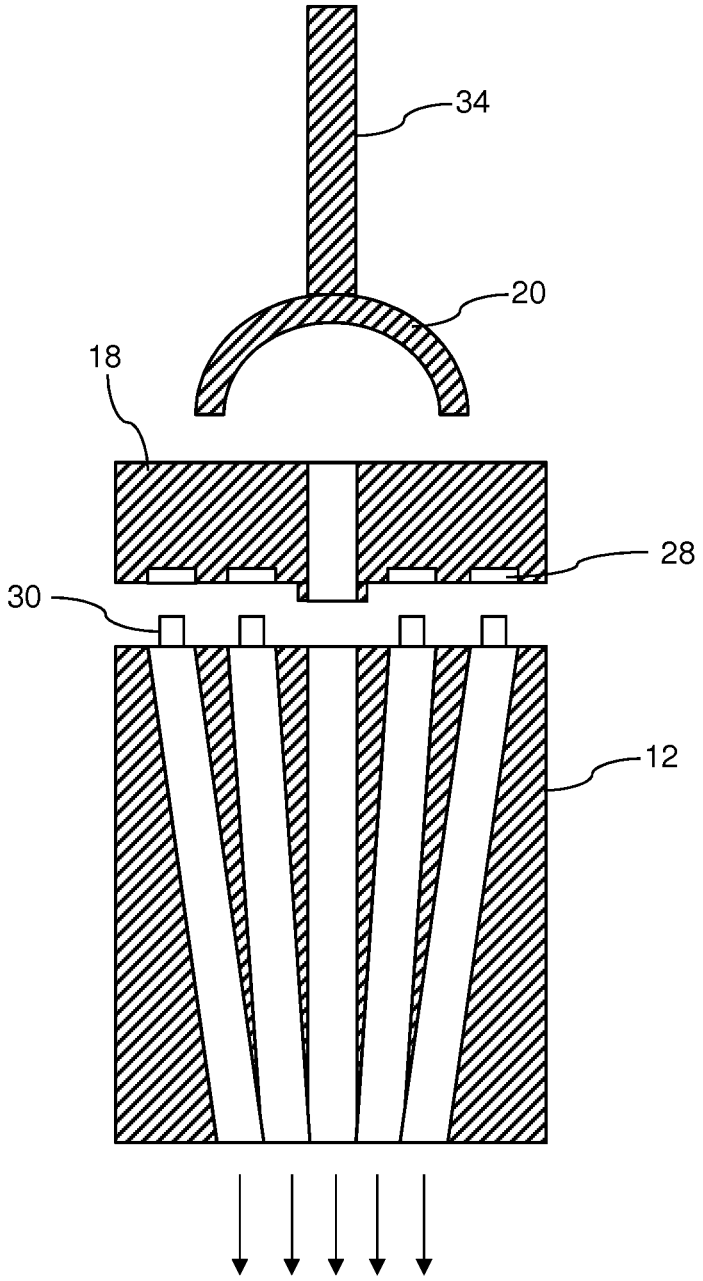

FIG. 5 shows the filling device 10 in its second position of operation with the sealing plate 18 moved away from the filler nozzle 12 and the separation between the sealing plate 18 and the flexible sealing component 12 maintained. Product 24 can now flow through all of the capillaries 14 including the central capillary 14*a*. The filler valve 16 is fully open and the product 24 enters the top of the capillaries 14 in the filler nozzle 12 and passes downwards through the capillaries 14 and into the open top of the partially formed container 26. The open tubes 28 at the top of the capillaries 14 can be clearly seen in this Figure, the central main capillary 14*a* is not provided with a tube 28.

Figure 6:
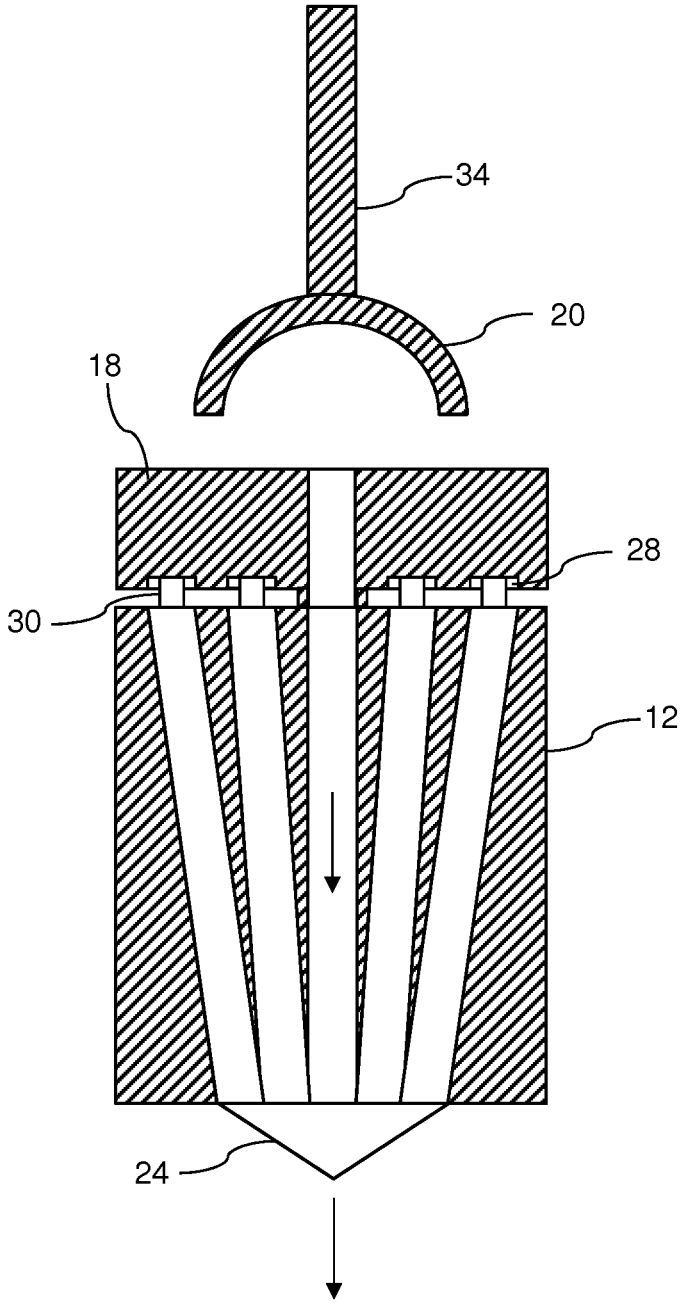

FIG. 6 shows the next stage of the operation of the filling device 10, in which the caps 30 of the sealing plate 18 have been moved into contact with the tubes 28 of the filler nozzle 12, closing the capillaries 14. In physical configuration, the position of the different components within the filling device 10 is identical to that shown in FIG. 4, although at the lower end of the now closed capillaries 14, product 24 can be seen forming as a drip at the end of the capillaries 14. The viscous nature of the product 24 and the weight of any particles within the product 24 tends to lead to such a drip 24 forming. Flow through the central capillary 14*a* continues as before and tends to drag the product 24 from the closed capillaries 14 towards the centre capillary 14*a*.

Figure 7:
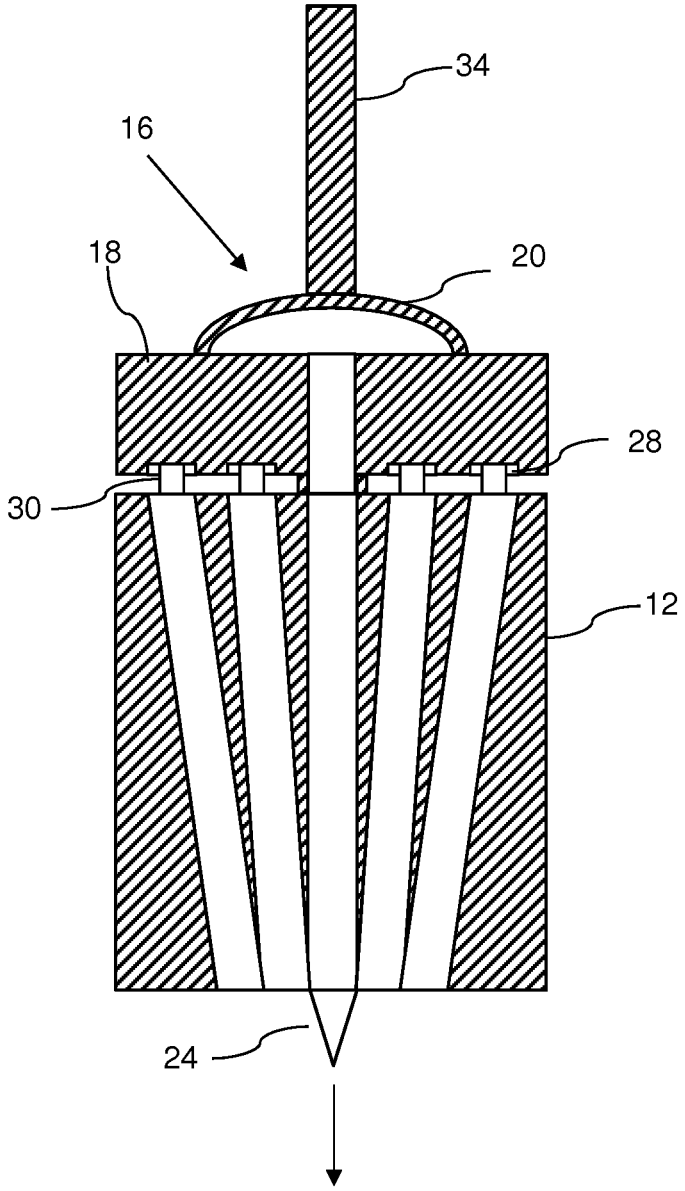

FIG. 7 shows the next stage in the operation of the filling device 10. The shaft 34 is arranged to move the flexible sealing component 20 into contact with the sealing plate 18 and apply pressure onto the flexible sealing component 20, which causes the flexible sealing component 20 to be compressed against the sealing plate 18 in order to create pressure through the elongate tube 32 and along the main capillary 14*a*. As can be seen in the Figure, more of the contents 24 will flow through and out of the central main capillary 14*a*, since the compressed sealing component 20 reduces the volume between the sealing component 20 and the sealing plate 18. This Figure shows the flexible sealing component 20 in its most compressed state, with the shaft 34 moved as far towards the sealing plate 18 as possible.

Figure 8:
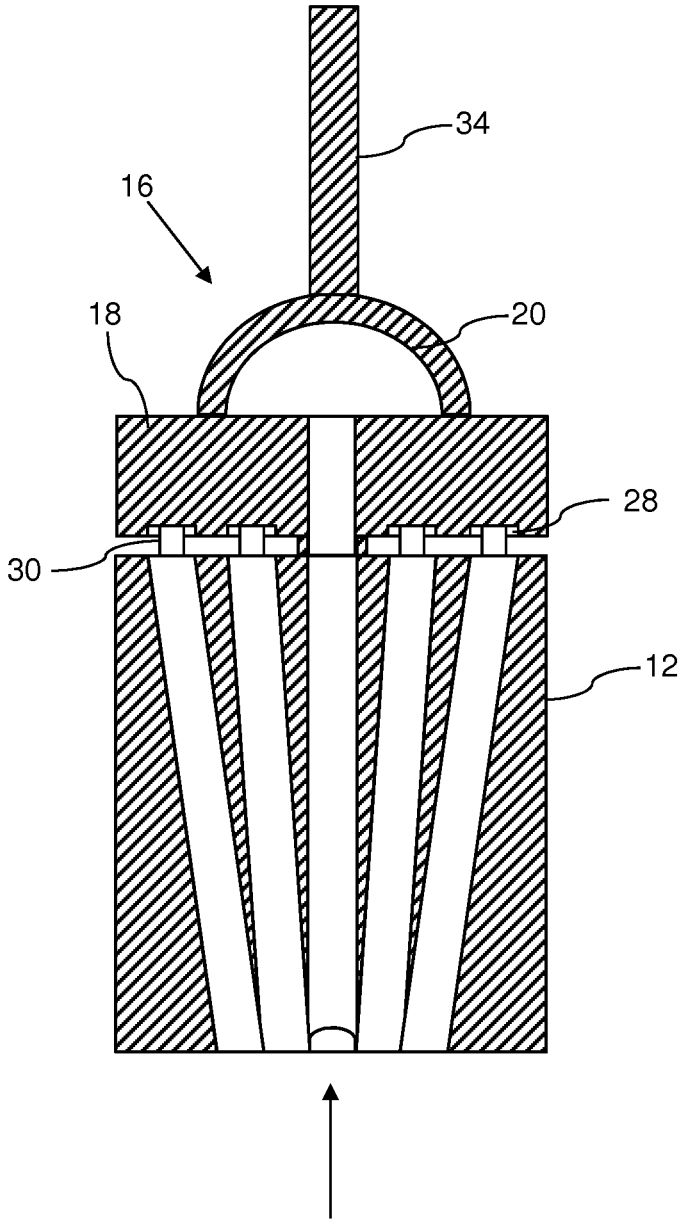

FIG. 8 shows the final stage of the operation of the filling device 10. The shaft 34 is moved away from the sealing plate 18 and this reverses the compression of the flexible sealing component 20, which creates suction along the main capillary 14*a*. This suction action draws into the capillary 14*a* any excess product 24 that is present on the exterior of the filler nozzle 12 and leaves the lower surface of the filler nozzle 12 clear of any product 24 that might drip uncontrollably from the filler nozzle 12. The final position of the components of the filling device 10 is identical to the starting position shown in FIG. 3, and the set of FIGS. 3 to 8 show one complete cycle of the operation of the filling device 10.

The preferred embodiment of the filling device 10 uses a sealing component 20 that is flexible and is operable to create the necessary pressure along the central capillary 14*a* by being compressed, as described above. However, other arrangements of the sealing component 20 are possible, such as using a metal bellows or a piston and cylinder arrangement. The sealing component 20 has two primary functions, firstly that the sealing component 20 can close the main capillary 14*a* and that the sealing component 20 is operable to create the pressure along the main capillary 14*a*. The operation of the sealing component 20 can also be reversed to create the suction along the length of the main capillary 14*a*.

Figure 9:
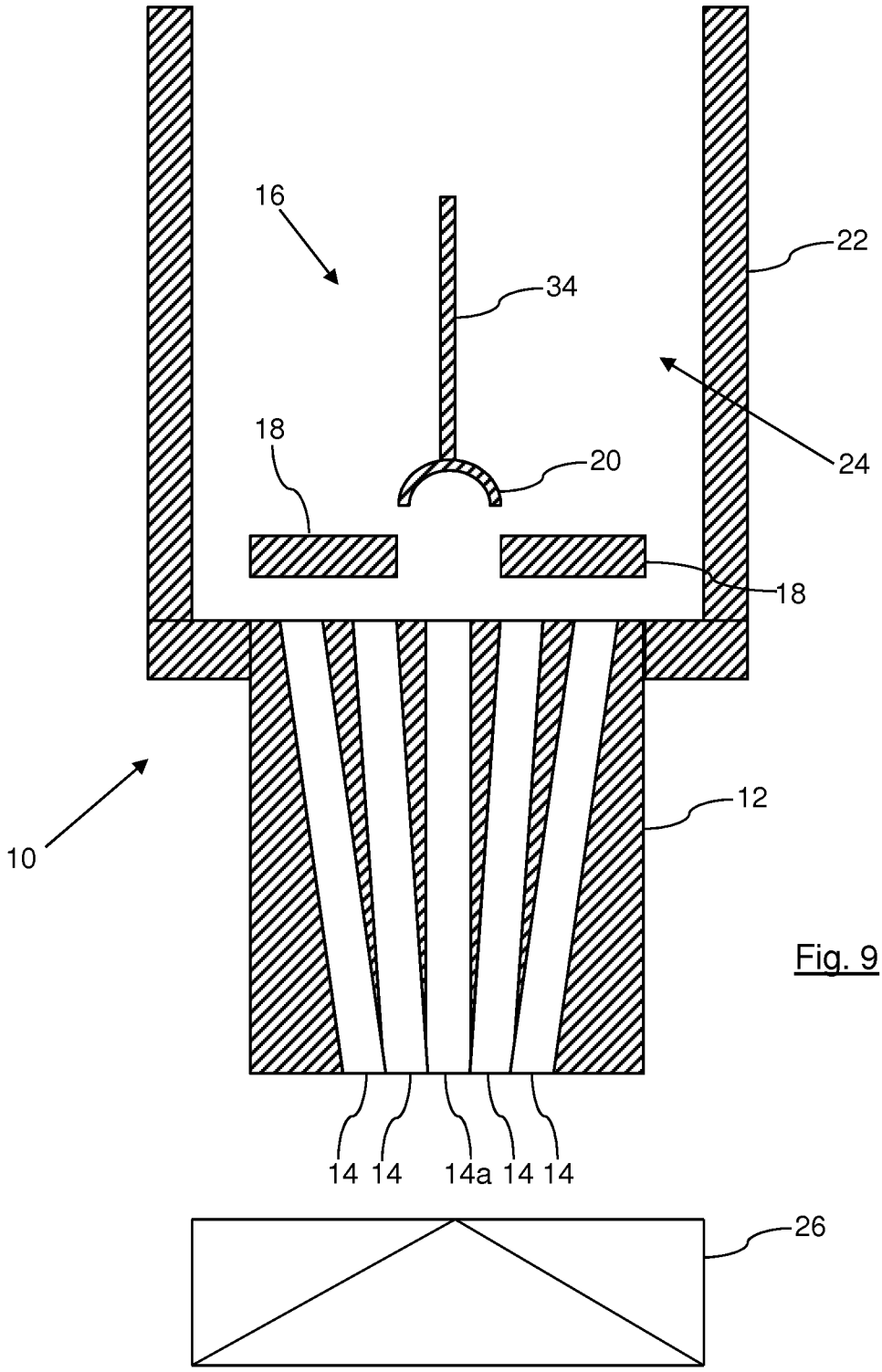
FIG. 9 is a vertical cross-section of a second embodiment of the filling device.

FIG. 9 shows a second embodiment of the filling device 10. The Figure shows a vertical cross-section through the filling device 10. The filling device 10 comprises a filler nozzle 12 comprising a plurality of capillaries 14, and a filler valve 16 moveable relative to the filler nozzle 12. The filler valve 16 is in two parts and comprises a sealing plate 18 which, when in contact with the filler nozzle 12, closes a plurality of the capillaries 14 but leaves at least one main capillary 14*a* open, and a sealing component 20 (connected to a shaft 34) moveable relative to the sealing plate 18, which closes the at least one main capillary 14*a*, and is operable to create pressure along the main capillary 14*a*.

The embodiment of the FIG. 9 differs from the first embodiment of FIGS. 1 to 8 in that the design of the two-part filler valve 16 is different. The sealing plate 18 (which can be formed in one piece or multiple parts) still closes a plurality of the capillaries 14 but leaves at least one main capillary 14*a* open and the sealing component 20 still closes the at least one main capillary 14*a*, and is operable to create pressure along the main capillary 14*a*. However, the sealing component 20 no longer in contact with the sealing plate 18 when the sealing component 20 closes the at least one main capillary 14*a*, the sealing component 20 is in direct contact with the filler nozzle 12.

The operation of the second embodiment of FIG. 9 is the same as that of the first embodiment, with the cycle of opening and closing of the two parts of the filler valve 16 working in the same way, with both parts being open first to allow product 24 to flow into the partially formed container 26. The sealing plate 18 then closes all of the capillaries 14 apart from the main capillary 14*a*. This is followed by the closing of the main capillary 14*a* by the sealing component 20 which then creates pressure down the main capillary 14*a* before reversing and creating suction along the main capillary 14*a*.

Figure 10:
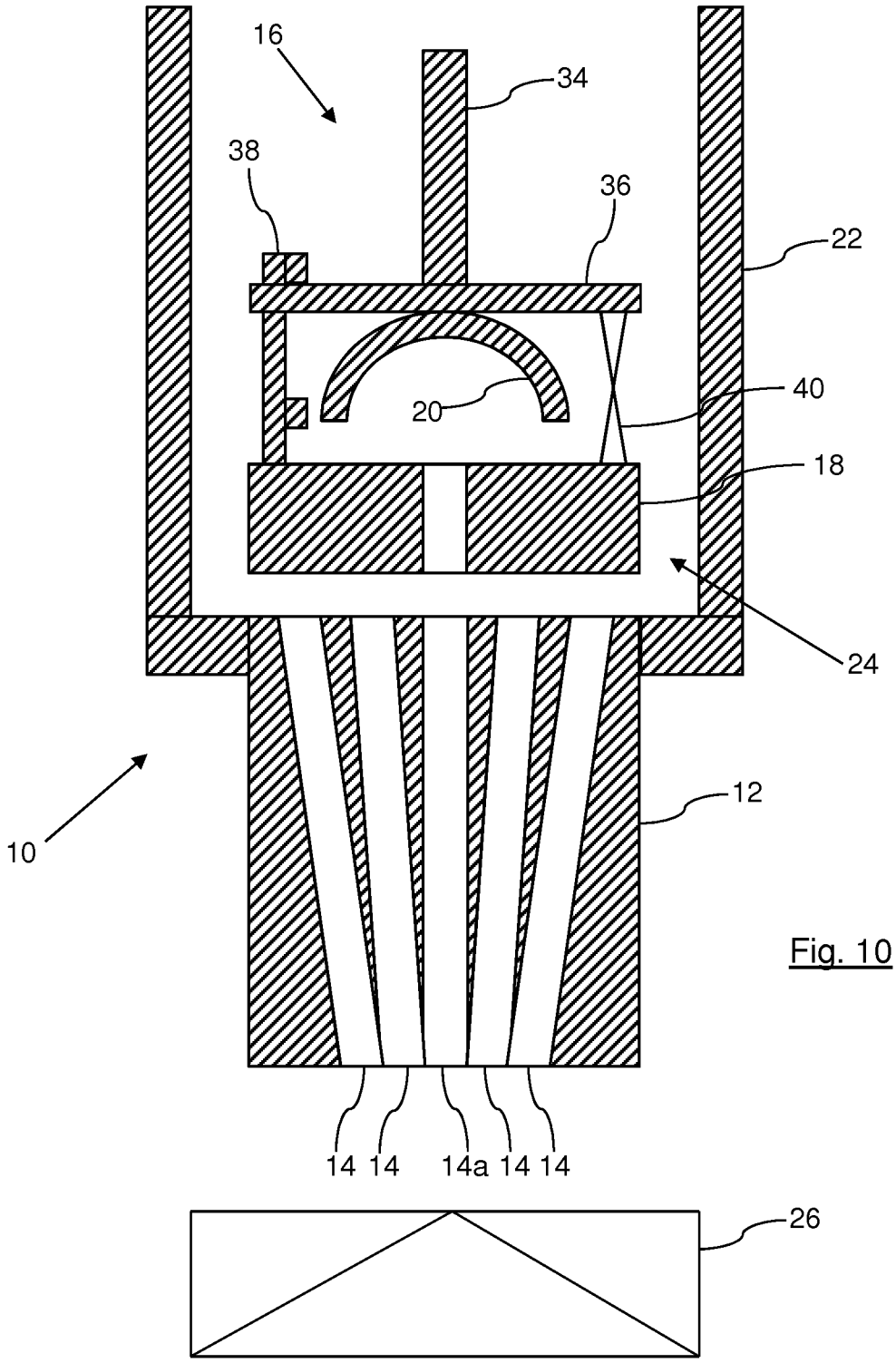
FIGS. 10 to 13 are a series of vertical cross-sections of a further embodiment of the filling device.

FIGS. 10 to 13 show a filler valve 16 of a yet further embodiment of the filling device 10. In the previous embodiments, two separate drives are required, one each for the sealing plate 18 and the sealing component 20, which have to be raised and lowered by separate drives. However, in the embodiment of FIGS. 10 to 13, only a single drive is required which operates through the shaft 34. The filler valve 16 has at the lower end of the shaft 34 a flat plate 36 which has three connecting pins 38 passing through holes in the flat plate 36. The pins 38 connect at their lower end to the sealing plate 18. One or more springs 40 (or any other resilient and elastic component) are provided which connect at one end to the flat plate 36 and at the other end to the sealing plate 18. The sealing component 20 is also connected to the underside of the flat plate 18. The view of the filler valve 16 shown in FIG. 10 is of the filler valve 16 in its open position with product 24 being able to flow through the capillaries 14. In the raised position shown in FIG. 10, as the shaft 34 is raised, the flat plate 36 rises to engage the top of the pins 38 which raises the sealing plate 18.

Figure 11:
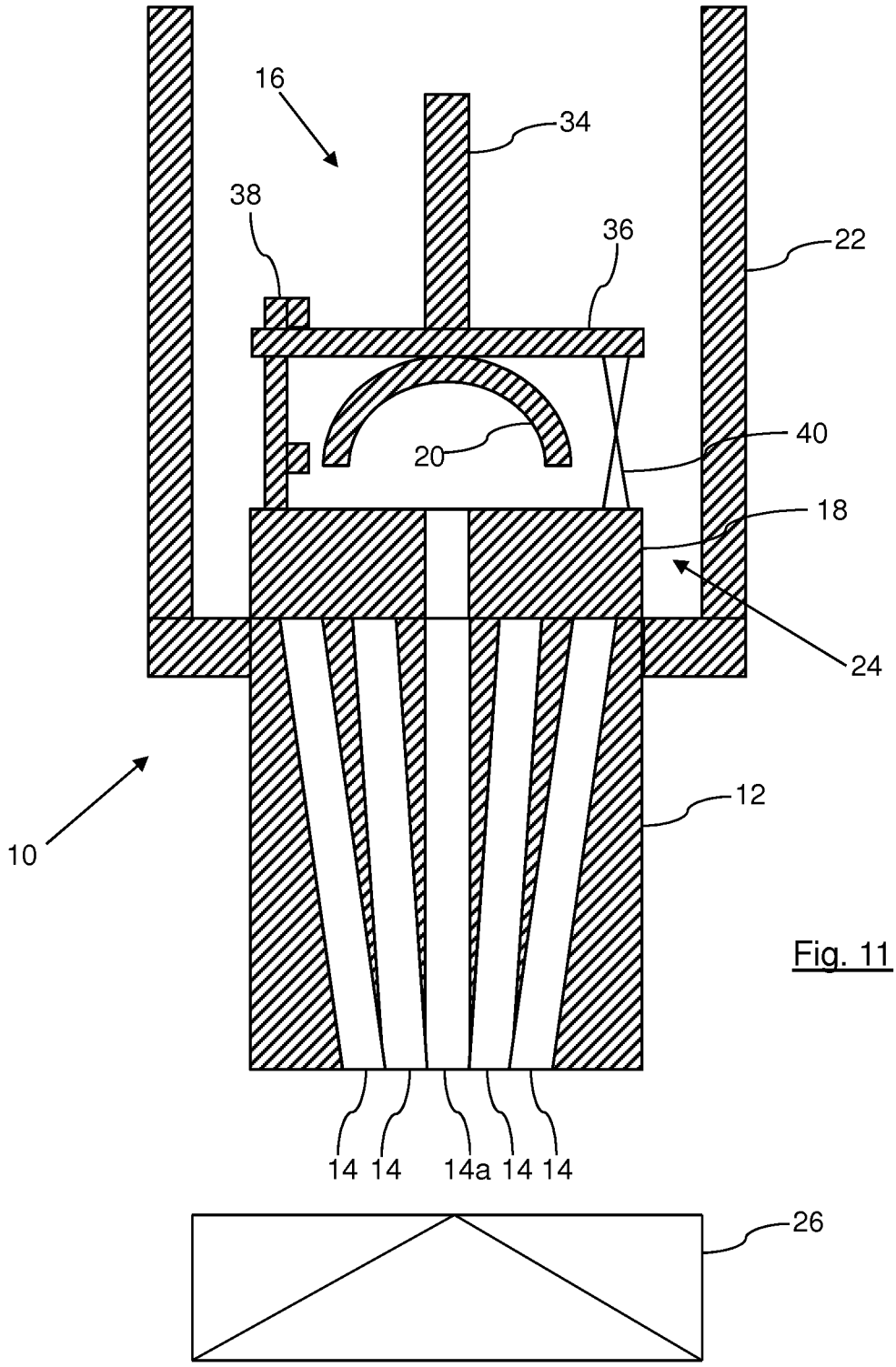

FIG. 11 shows the filler valve 16 after the filler valve 16 has been lowered (by the shaft 34) so that the sealing plate 18, which is now in contact with the filler nozzle 12, closes all of the capillaries 14 apart from the main capillary. The sealing component 20 is still in its open position, so that product 24 can flow through the main capillary 14*a*. The sealing plate 18 is pushed downwards with the force acting from the shaft 34 and through the spring(s) 40 to the sealing plate 18.

Figure 12:
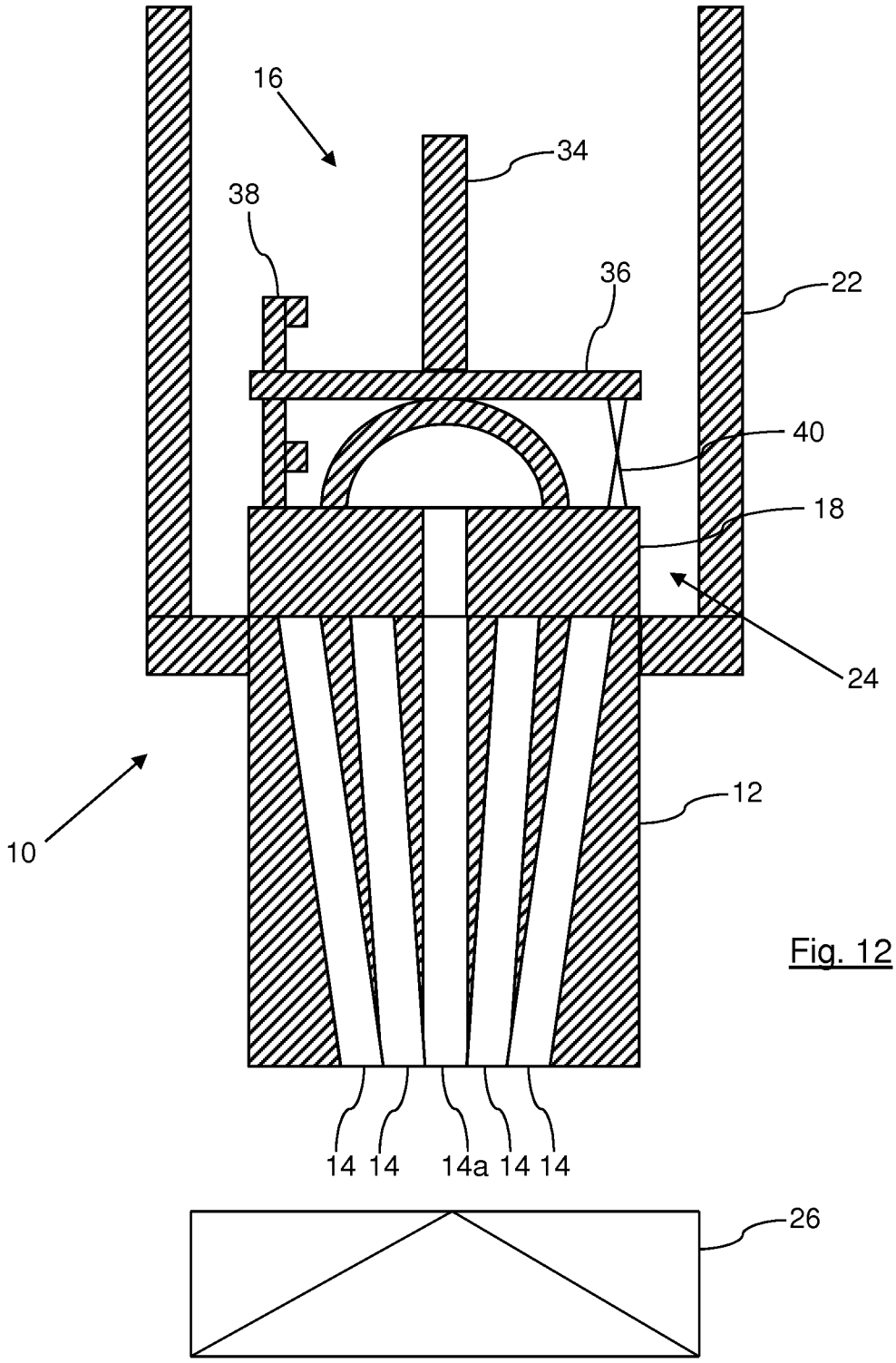

FIG. 12 shows the positions of the components of the filler valve 16 after all of the capillaries 14 in the filler nozzle 12 have been closed. The shaft 34 is lowered and this causes the flat plate 36 to move downwards which causes pressure through the springs 40 to move the sealing plate 18 downwards to engage the top of the filler nozzle 12. The sealing component 20 has now moved down and into contact with the sealing plate 18 which closes the main capillary 14*a* in the centre of the filler nozzle 12. The relative movement between the various parts has caused the flat plate 18 to no longer be engaged with the pins 38. At this point in the operational cycle of the filler valve 16, the only pressure on the sealing plate 18 is through the springs 40.

Figure 13:
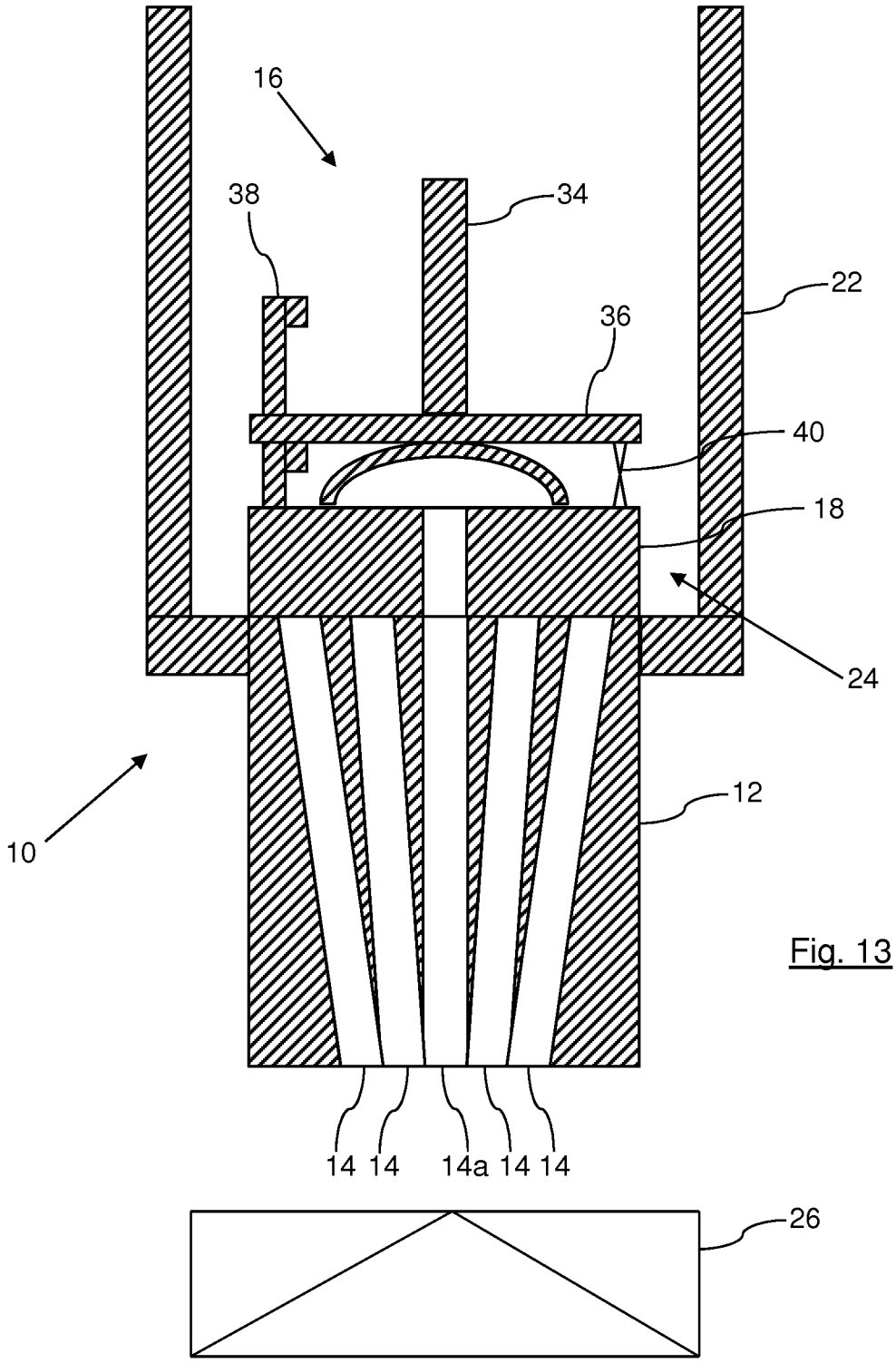

FIG. 13 shows the filler valve 16 in the point in its operation when the sealing component 20 has been compressed and is providing pressure through the main capillary 14*a*. The shaft 34 has been lowered to its furthest possible extent, compressing the sealing component 20 against the sealing plate 18. The flat plate 36 is now at its lowest possible point relative to the pins 38. After the pressure has been generated along the main capillary 14*a* then the shaft 36 is raised slightly, which will allow the sealing component 20 to decompress and create suction along the main capillary 14*a*, returning to the operational configuration shown in FIG. 12.

The use of one or more springs 40 in the embodiment of FIGS. 10 to 13 has a number of different advantages. Firstly the spring(s) 40 assist in keeping the sealing plate 18 horizontal within the sealing valve 16, ensuring that a good seal is continually made in the operation of the sealing plate 18, as this sealing plate 18 is raised and lowered every time a container 26 is filled with product. Secondly, the spring(s) 40 provide a route for the force required to be delivered to the sealing plate 18 from the shaft 34. If the springs 40 were not present then the force that pushes down the sealing plate 18 would pass through the sealing component 20, which would greatly increase the wear and tear on this component 20.

Figure 14:
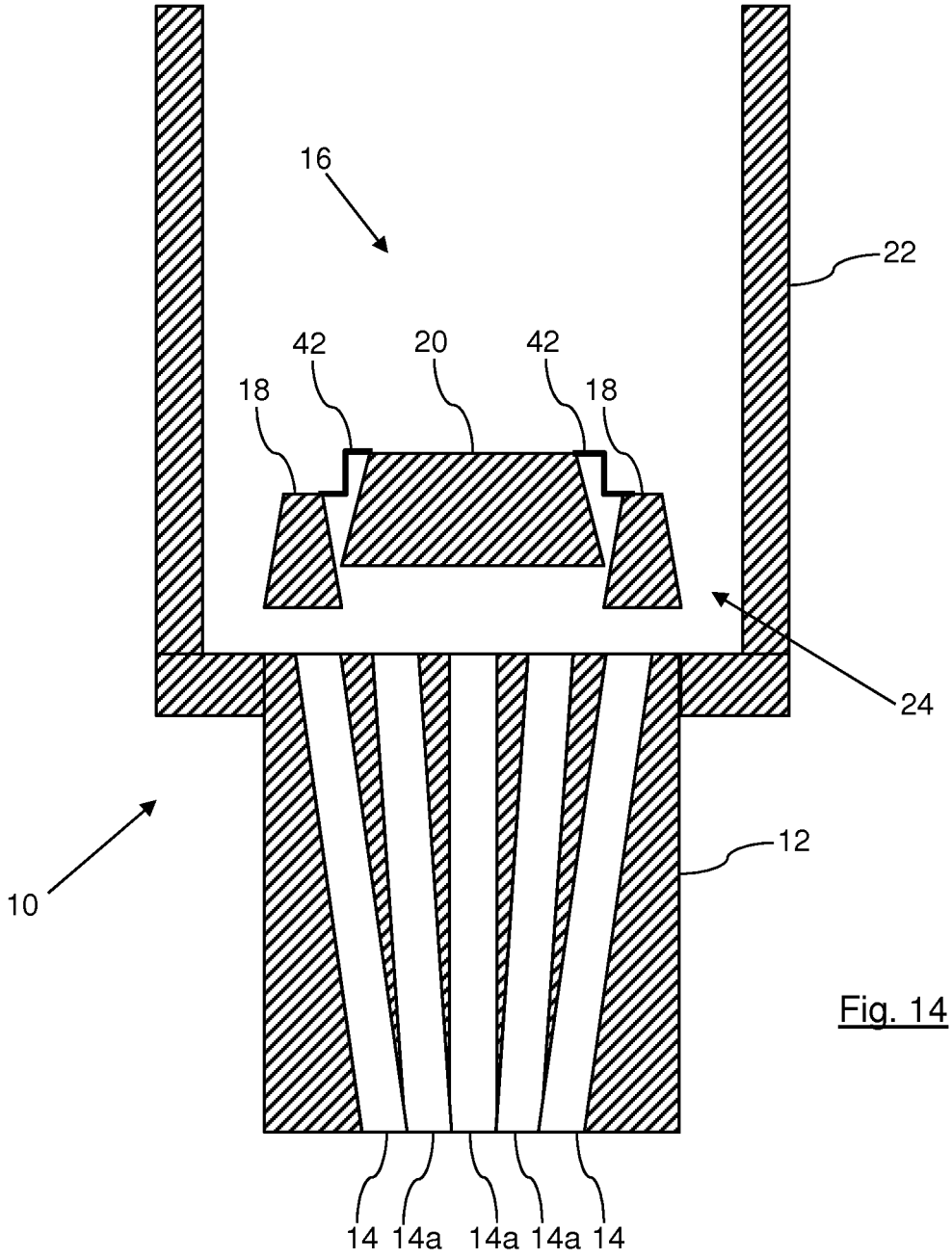
FIGS. 14 to 16 are a series of vertical cross-sections of a yet further embodiment of the filling device.
Figure 15:
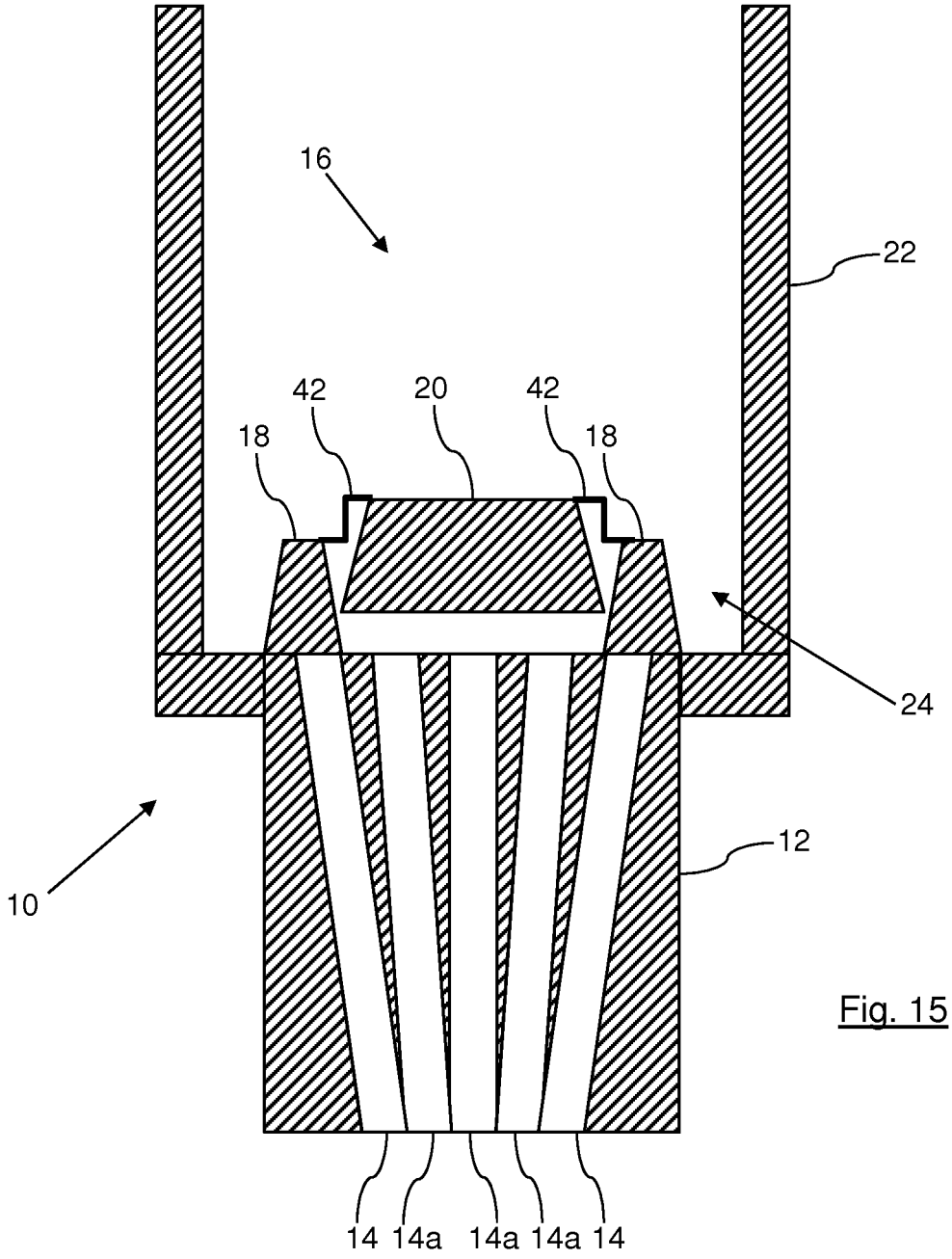
Figure 16:
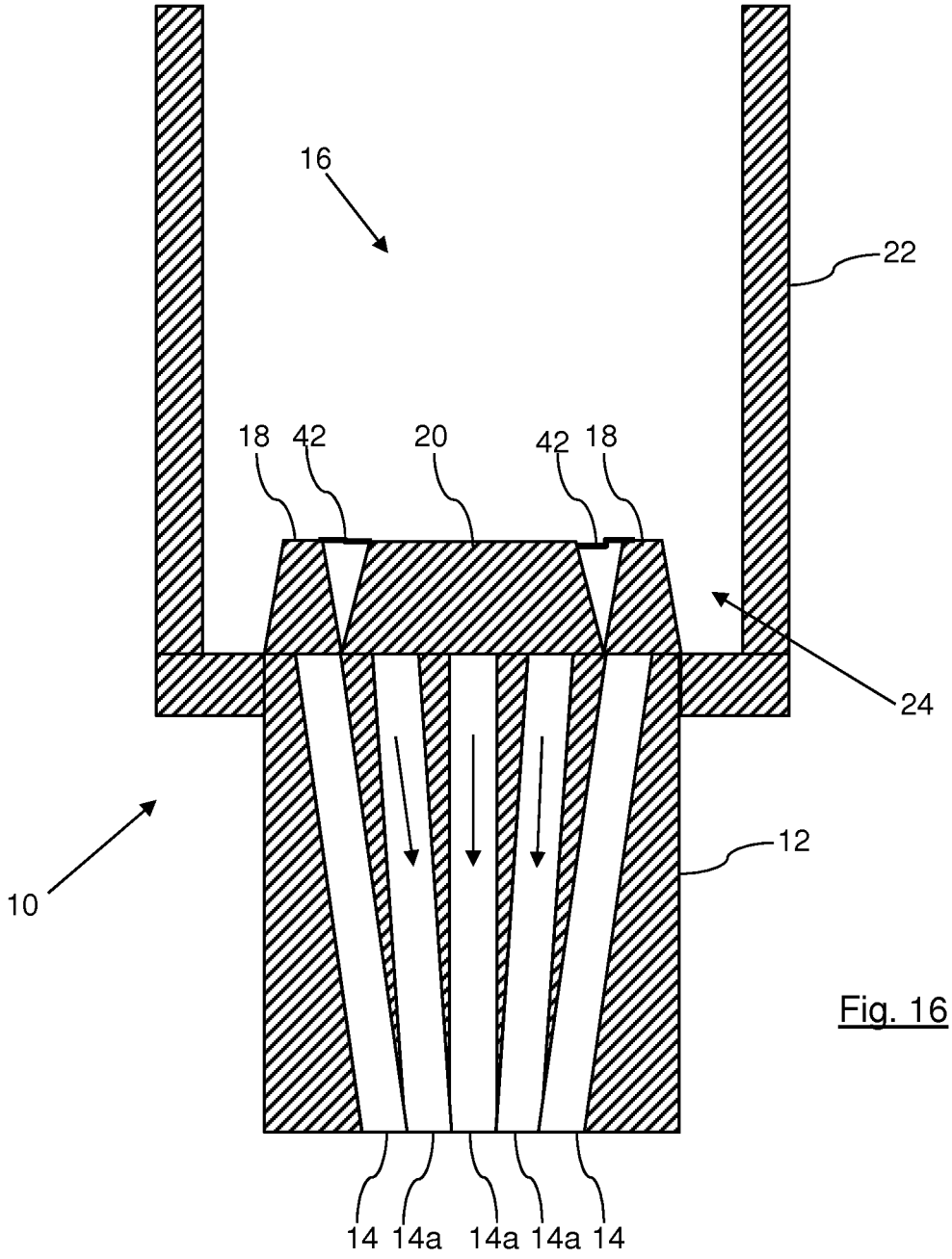

FIGS. 14 to 16 show a yet further embodiment of the filling device 10, where the configuration of the filler nozzle 12 is the same as before, but the configuration of the filler valve 16 is different. In this embodiment, the sealing plate 18 is connected to the sealing component 20 by a flexible membrane 42. The sealing plate 18 and the sealing component 20 can still move independently of each other although the range of movement is limited by the size of the membrane 42. The sealing component 20 seen from above is circular with the sealing plate 18 being a ring around the sealing component 20.

FIG. 14 shows the fully open position of the filler valve 16, with product 24 being able to flow through all of the capillaries 14. FIG. 15 shows the next position of the filler valve 16, in which all of the capillaries 14 are now closed and no product 24 is flowing from the filler nozzle 12. FIG. 16 shows the next position of the filler valve 16 in which the sealing component 20 has been operated to close the main capillaries 14*a* and to create pressure through these main capillaries 14*a*. The next position of the filler nozzle 16 is that shown in FIG. 15, with the sealing component 20 being raised relative to the sealing plate 18 which creates the suction back along the main capillaries 14*a*.

The cross-section shape of the sealing plate 18 and the sealing component 20 shown in FIGS. 14 to 16 is that of an isosceles trapezoid, however other shapes could also be used and would provide a functioning filler valve. For example, a rectangular cross-section could be used and a small spacing between the sealing plate 18 and the sealing component 20 can be provided.

The invention claimed is:

1. A filling device comprising:

a filler nozzle comprising a plurality of capillaries, and a filler valve moveable relative to the filler nozzle, wherein the filler valve comprises:

a sealing plate which, when in contact with the filler nozzle, closes a plurality of the capillaries but leaves at least one main capillary open, and a flexible sealing component which is compressible and moveable relative to the sealing plate, which is operable to close the at least one main capillary and, by being compressed, to create pressure along the at least one main capillary, wherein the sealing plate comprises one or more elongate tubes passing through the sealing plate between a first side of the sealing plate and a second side of the sealing plate, the one or more elongate tubes being arranged, at the first side of the sealing plate, to engage with the at least one main capillary, and the one or more elongate tubes, at the second side of the sealing plate, terminating adjacent to the flexible sealing component, the one or more elongate tubes providing a connection from the at least one main capillary to the second side of the sealing plate where the at least one main capillary is closable by the flexible sealing component.

2. A filling device according to claim 1, wherein the plurality of capillaries are arranged longitudinally within the filler nozzle.

3. A filling device according to claim 1, wherein the at least one main capillary is located centrally within the filler nozzle.

4. A filling device according to claim 1, wherein the sealing plate, when in contact with the filler nozzle closes a plurality of the capillaries but leaves only one main capillary open.

5. A filling device according to claim 1, wherein the sealing component comprises a flexible cap of silicone rubber or any flexible plastics material.

6. A filling device according to claim 1, wherein each capillary closed by the sealing plate, at an end of the filler nozzle adjacent to the sealing plate, includes a tube extending from the filler nozzle.

7. A filling device according to claim 1, wherein the or each main capillary, at an end of the filler nozzle adjacent to the sealing plate, terminates at the filler nozzle.

8. A filling device according to claim 7, wherein the sealing plate comprises, on its side adjacent to the filler nozzle, a plurality of caps arranged to close each capillary closed by the sealing plate and the one or more elongate tubes arranged to engage with the or each main capillary.

9. A filling device according to claim 8, wherein the one or more elongate tubes arranged to engage with the or each main capillary pass through the sealing plate and terminate adjacent to the sealing component.

10. A filling device according to claim 1, and further comprising a shaft connected to the sealing component and connected to one or more resilient and elastic components, the elastic components connected to the sealing plate.

11. A filling device according to claim 1, and further comprising a flexible membrane, wherein the sealing plate is connected to the sealing component by the flexible membrane.

12. A method of operating a filling device comprising:

opening a sealing plate of a filler valve to provide a flowable product from a filler nozzle comprising a plurality of capillaries, to a partially formed container, the sealing plate comprising one or more elongate tubes passing through the sealing plate between a first side of the sealing plate and a second side of the sealing plate, the one or more elongate tubes being arranged, at the first side of the sealing plate, to engage with at least one main capillary, and the one or more elongate tubes, at the second side of the sealing plate, terminating adjacent to a flexible and compressible sealing component, wherein the method further comprises:

closing the sealing plate which, when in contact with the filler nozzle, closes a plurality of the capillaries but leaves the at least one main capillary open, closing a flexible sealing component of the filler valve, which closes the at least one main capillary, operating the sealing component to compress the sealing component to create pressure along the at least one main capillary, and reversing the operation of the sealing component to release compression of the sealing component to create suction along the at least one main capillary.

13. A method according to claim 12, wherein the plurality of capillaries are arranged longitudinally within the filler nozzle.

14. A method according to claim 12, wherein the at least one main capillary is located centrally within the filler nozzle.

15. A method according to claim 13, wherein the sealing plate, when in contact with the filler nozzle closes a plurality of the capillaries but leaves only one main capillary open.

16. A method according to claim 12, wherein the sealing component comprises a flexible cap of silicone rubber or any flexible plastics material.

17. A method according to claim 12, wherein each capillary closed by the sealing plate, at the end of the filler nozzle adjacent to the sealing plate, includes a tube extending from the filler nozzle.

18. A method according to claim 13, wherein the or each main capillary, at the end of the filler nozzle adjacent to the sealing plate, terminates at the filler nozzle.

19. A method according to claim 18, wherein the sealing plate comprises, on its side adjacent to the filler nozzle, a plurality of caps arranged to close each capillary closed by the sealing plate and the one or more elongate tubes arranged to engage with the or each main capillary.

20. A method according to claim 19, wherein the one or more elongate tubes arranged to engage with the or each main capillary pass through the sealing plate and terminate adjacent to the sealing component.

* * * * *